US006113002A

United States Patent [19]

Finkbeiner

[11] Patent Number: 6,113,002

[45] **Date of Patent: *Sep. 5, 2000**

[54] SHOWER DEVICE HAVING A RESILIENTLY DEPRESSIBLE JET DISK FOR REMOVING MINERAL DEPOSITS

[75] Inventor: Werner Finkbeiner, Schiltach, Germany

[73] Assignee: Hansgrohe AG, Schiltach, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/120,543

[22] Filed: Jul. 22, 1998

[30] Foreign Application Priority Data

Aug. 1, 1997 [DE] Germany ..... 197 33 291

[51] Int. Cl.[7] ..... B05B 15/02

[52] U.S. Cl. ..... 239/106; 239/533.13; 239/548; 239/602; 239/DIG. 12; 239/DIG. 19

[58] Field of Search ..... 239/104, 106, 239/107, 533.13, 548, 589, 602, DIG. 12, DIG. 19

[56] References Cited

U.S. PATENT DOCUMENTS

| | | | |
|---|---|---|---|
| 3,104,819 | 9/1963 | Aghnides | 239/106 |
| 3,109,591 | 11/1963 | Moen | 239/107 |
| 3,383,050 | 5/1968 | Crist et al. | 239/436 |
| 3,409,717 | 11/1968 | Nozaki | 264/291 |
| 3,719,328 | 3/1973 | Hindman | 239/546 |
| 4,244,526 | 1/1981 | Arth | 239/533.1 |

FOREIGN PATENT DOCUMENTS

| | | | |
|---|---|---|---|
| 2 446 134 | 8/1980 | France . | |
| 22 35 217 | 2/1973 | Germany . | |
| 79 04 756 | 7/1980 | Germany . | |
| 2177621 | 1/1987 | United Kingdom | 239/107 |

*Primary Examiner*—Lesley D. Morris
*Attorney, Agent, or Firm*—Duane, Morris & Heckscher LLP

[57] ABSTRACT

A shower device having a flexible, flat jet or spray disk is created, in which at least one surface zone is curved outwards and on exceeding a specific pressing in force (E) exerted thereon springs round suddenly with the curvature inwards into a space located behind it and automatically springs back to the starting position when the force is relieved. As a result of the springing or springing round, it is possible to detach lime deposits from the jet disk.

37 Claims, 3 Drawing Sheets

SHOWER DEVICE HAVING A RESILIENTLY DEPRESSIBLE JET DISK FOR REMOVING MINERAL DEPOSITS

FIELD OF USE AND PRIOR ART

The invention relates to a shower device having a flexible, flat jet or spray disk.

Shower devices with a flat jet disk are very widely used. U.S. Pat. No. 3,383,050 discloses a shower head, which has a flexible jet disk for adjusting the shower jets. The convexity can be varied by means of a central screw. A similar jet disk is described in DE-OS 2 235 217.

German utility model 79 04 756 discloses a shower having an elastically deformable jet disk. As a result of the deformability of the jet disk, it can be zonally, manually pressed in, permitting the detachment of disturbing lime deposits on its surfaces and in the vicinity of water passage channels formed by holes. As a result of the pressing in of the jet disk, the latter is deformed to such an extent that deposits are detached and can be flushed away.

Besides impairing the optical impression of the shower, lime deposits suffer from the disadvantage of clogging and even blocking the water passage channels, so that in certain circumstances the operation of the shower can be very significantly impaired. In addition, lime and other deposits are not hygienic.

PROBLEM AND SOLUTION

The problem of the invention is to provide a shower device in which lime and other deposits can be easily and reliably removed.

This problem is solved by a shower device having a flexible, flat spray or jet disk, in which at least one surface zone of the jet disk is curved outwards and on exceeding a specific pressing in force exerted thereon springs round suddenly with the curvature inwards into an area located behind it and on relieving the force automatically springs back into the starting position.

These springing or jumping processes during a deformation of the jet disk bring about, in addition to the deformation of the latter, both acceleration forces and also a vibration of said jet disk. As a result of the special nature of the invention, three factors aid a detachment of lime or other deposits. In particular, the vibration of the jet disk and the complete shower device brings about a detachment of rigid lime deposits in the vicinity of the jet disk. The jet disk can be given widely differing shapes and in particular contours. As a result of the springing out of the jet disk, it is ensured that it automatically returns in all cases to the starting position.

In order to permit a deliming of the shower device according to the invention without great effort and expenditure for a user, the at least one surface zone can be pressed in with one finger. This can e.g. take place during the use of the shower device, so that detached lime or other deposits are flushed by the shower water out of the shower device. To facilitate the initiation of the deliming process, the surface of the jet disk and in particular the at least one surface zone which can be pressed in, can be larger than a finger tip.

Advantageously, a jet disk has a clearly defined contact surface for the application of a force, e.g. by finger pressure. The contact surface is preferably smaller than the surface zone and in particular has a diameter, which is somewhat less than half the diameter of the surface zone. The contact surface can have a random shape.

In a preferred development of the invention, a jet disk is provided with at least one material weakening, particularly along a substantially closed line. The material weakening can extend over a width roughly located in the vicinity of the average thickness of the jet disk and can be produced in various ways.

Advantageously, the wall thickness of the material weakening, particularly a material thinning, is in a range between 10 and 60% of the average jet disk thickness and is preferably approximately 30%. Such a material weakening permits a clearly defined springing round of the domed jet disk. The material weakening is preferably constructed as a film hinge.

It is also possible to have the material weakening along a line through recesses or holes along said line. As a result of the spacing and diameter of said holes, it is possible to vary the material weakening. As a result of the design possibilities for the material weakening, it is possible to influence the springing round of at least one surface zone of the jet disk both with respect to its surface area and with respect to the springing round process.

The shower device can have a solid component, which is outwardly connected to an outer material weakening, particularly of the jet disk. It preferably frames the jet disk. In order to give the jet disk the necessary strength, said component can be constructed in a particularly torsionally strong manner, e.g. by a wall thickness, which is considerably greater than the average thickness of the jet disk. The construction of the shower device is simplified if the solid component is directly connected to the material weakening. The solid component serves as a type of frame, which contains both the jet disk and material weakening, as well as in particular absorbing the forces occurring during its deformation, especially those occurring roughly radially without giving way thereto.

For a compact and in particular stable construction of the shower device, the jet disk is preferably connectable or connected to the solid component. In particularly advantageous manner both are constructed in one piece as an assembly, which facilitates manufacture, installation and handling.

In a preferred development of the invention, the jet disk is made from plastic, preferably a thermoplastic. As a result the jet disk can be produced by injection moulding. The flexibility of the jet disk is obtained by its construction with a limited wall thickness. Through the use of a plastics material, a construction of the jet disk is obtained with a film hinge in the form of the material weakening, which surrounds at least one inwardly pressable surface zone. The latter is variable along said film or ring hinge in its position relative to the remaining shower device, particularly the solid component.

The solid component can have a cylindrical pipe section, which is preferably connectable to a shower casing. A one-piece construction of the component with the pipe section is considered particularly advantageous. The connection to the shower casing is e.g. possible via a screw thread. The solid component can have a solid flange externally connected to the jet disk and which is preferably connectable to the shower casing. Such a flange improves the stability of the component, particularly with respect to radial forces emanating from the jet disk during the pressing in or back process.

Advantageously, the material weakening is annular. It can have a diameter of approximately 10 to 60 mm, a diameter of approximately 20 to 40 mm being considered particularly favourable.

Advantageously, the jet disk has an average wall thickness of approximately 0.4 to 1 mm, particularly approximately 0.7 mm. Such a material thickness is considered to give adequate flexibility in the case of the preferably used plastics. It gives the jet disk the necessary strength for use in a shower device. Thus, the jet disk can withstand the force exerted by an unknowing or careless user, which is a multiple of the pressing in force preferably used on pressing in.

The material thickness of the material weakening is preferably between 0.1 and 0.5 mm, particularly between 0.2 and 0.3 mm. This allows a clear reduction in the wall thickness of the material, limited to a small width, in the vicinity of the material weakening, compared with the remainder of the jet disk and accompanied by the formation of a film hinge. If, in an alternative construction, the material weakening is in the form of a perforation, the wall thickness in the vicinity of the webs of the surrounding material between the holes, can roughly correspond to the material thickness of the jet disk.

It is considered advantageous for the function and handling of the shower device for the contact surface to be positioned within the material weakening and preferably the surface centres are close to one another or may coincide. In this way a precise and uniform snapping round of the pressed in surface zone of the jet disk is obtained, because the radial forces caused when applying a pressing in force are distributed roughly uniformly along the material weakening.

The jet disk can be rotationally symmetrically shaped or made and preferably maintains said rotational symmetry both in the starting position and the maximum inwardly curved state. Preferably, the rotational symmetry is also maintained during a correctly performed pressing in or back process. In the manner of a click stop, the jet disk, in a particularly preferred embodiment, not only suddenly springs round, but produces as a result of said sudden springing round a preferably clicking noise. This noise indicates to a user, that the jet disk is springing round and lime and other deposits are blown off. Thus there is an acoustic back indication concerning the springing round process.

The contact surface is preferably provided with a stiffening or the like, which can in particular be in the form of a stiffening ring or rib. The stiffening aids the uniform springing round and in particular the automatic springing back of a pressed in jet disk. If the stiffening is on the outside of the contact surface, particularly in the form of a rib, it can serve as a centring aid for a finger applied to the contact surface, so that the pressing in force takes place intuitively at the optimum point for the snapping round process.

The contact surface preferably has a diameter of approximately 5 to 15 mm, particularly approximately 10 mm. This size range is particularly suitable for the intuitive feeling with the finger and for an adequately precisely defined application of the pressing in force.

In a preferred development, the contact surface is not curved outwards. It can be zonally or sectionwise planar or curved inwards.

Water passage channels for the water flowing through the shower device are preferably formed by holes within the material weakening, particularly also within the contact surface. The holes can have different configurations, e.g. different cross-sectional shapes or diameters. In this way, the water can be split up into a plurality of water jets, created as a function of the design of the water passage channels. It is also possible to have massage jets, which are in particular discharged discontinuously with a high exit speed from the jet disk. The holes can be arranged in a random manner, but preferably in concentric rows. The centre of the concentric rows can coincide with the axis of symmetry of a rotationally symmetrical jet disk. The holes of one row can be displaced with respect to the holes of neighbouring rows.

In a preferred development of the invention, in a central area, particularly a circular and preferably uninterrupted central area, the jet disk can be inwardly curved. This central area can be located in the centre of the jet disk or the contact surface. Such a curved central area centres the pressing in force applied by finger pressure by the user. The snapping round process of the jet disk is improved by said central area, because through the inward curvature thereof, the jet disk material surrounding it, on exceeding a springing round point, is automatically curved inwards with a specific pitch. Preferably, the central area has a diameter of 1 to 8 mm and with particular advantage approximately 4 mm. The vertical clearance of the centre of said central curvature over the plane of the contact surface is between 0.2 and 0.8 mm, particularly approximately 0.5 mm. The material thickness in the vicinity of the central curvature is roughly the average thickness of the jet disk. The inwardly curved central area is preferably free from holes.

Preferably, the at least one domed surface zone or the jet disk in the starting position has no pretension. As a result of the relieved position of the jet disk, it maintains its position optimized for the normal shower process, in the absence of external influences. A springing back from the pressed in state by removing the pressing in force, takes place in a particularly defined and established manner, if the jet disk can spring back into a position, where it is exposed to no significant force influences.

An outward curvature of the at least one surface zone can preferably amount to approximately 2 to 15% of the surface zone diameter, i.e. the vertical clearance of the curvature maximum over the plane of the material weakening is consequently roughly this surface zone diameter proportion. With particular advantage the figure is 7 to 10%.

A curvature of the at least one surface zone following the inward pressing in can be roughly the same as the outward extension of the curvature. A springing round between two such positions produces a jump or click action, which is looked upon as adequately fulfilling the many advantages of the invention with respect to lime removal. The jump or click occurs in a force maximum passed during each springing round. The path of the curvature, in particular the significantly conically tapering part of the jet disk, can form an angle of approximately 10° with the plane of the material weakening.

The pressing in force for a surface zone is preferably between 10 and 120 N, particularly between 30 and 90 N and with particular advantage approximately 77 N. This is looked upon as a force range, in which on the one hand the force can be applied without significant effort by finger pressure by a user and on the other where a snapping round process adequately removing lime deposits is achieved. A restoring force of the surface zone is between 5 and 60 N, particularly approximately between 10 and 50 N and with particular advantage at approximately 45 N.

In a preferred development of the invention, the jet or spray disk can be made from a halogen-free thermoplastic with a dimensional stability up to 100° C., preferably up to 120° C., e.g. of polyoxymethylene or polypropylene. Its modulus of elasticity is between 800 and 1600 N/mm$^2$, preferably at approximately 1200 N/mm$^2$, and is considered advantageous for the design and use of the jet disk in a shower device. These plastics can be produced with a very smooth surface, which makes it difficult for deposits to form and facilitates the removal thereof by a snapping round process according to the invention.

The shower device is preferably constructed as a shower head, particularly as a head or side shower, for connection to a fixed wall connection, which is directionally adjustable in a certain range by means of a spherical joint and has a circular jet disk, whose diameter is approximately 26 mm.

These and further features can be gathered from the claims, description and drawings and the individual features, both singly and in random subcombinations, can be implemented in an embodiment of the invention and in other fields and can represent advantageous, independently protectable constructions for which protection is hereby claimed. The subdivision of the application into individual sections and subheadings in no way restrict the general validity of statements made thereunder.

BRIEF DESCRIPTION OF THE DRAWINGS

An embodiment of the invention is described hereinafter relative to the drawings, wherein show.

DESCRIPTION OF A PREFERRED EMBODIMENT

Figure 1:
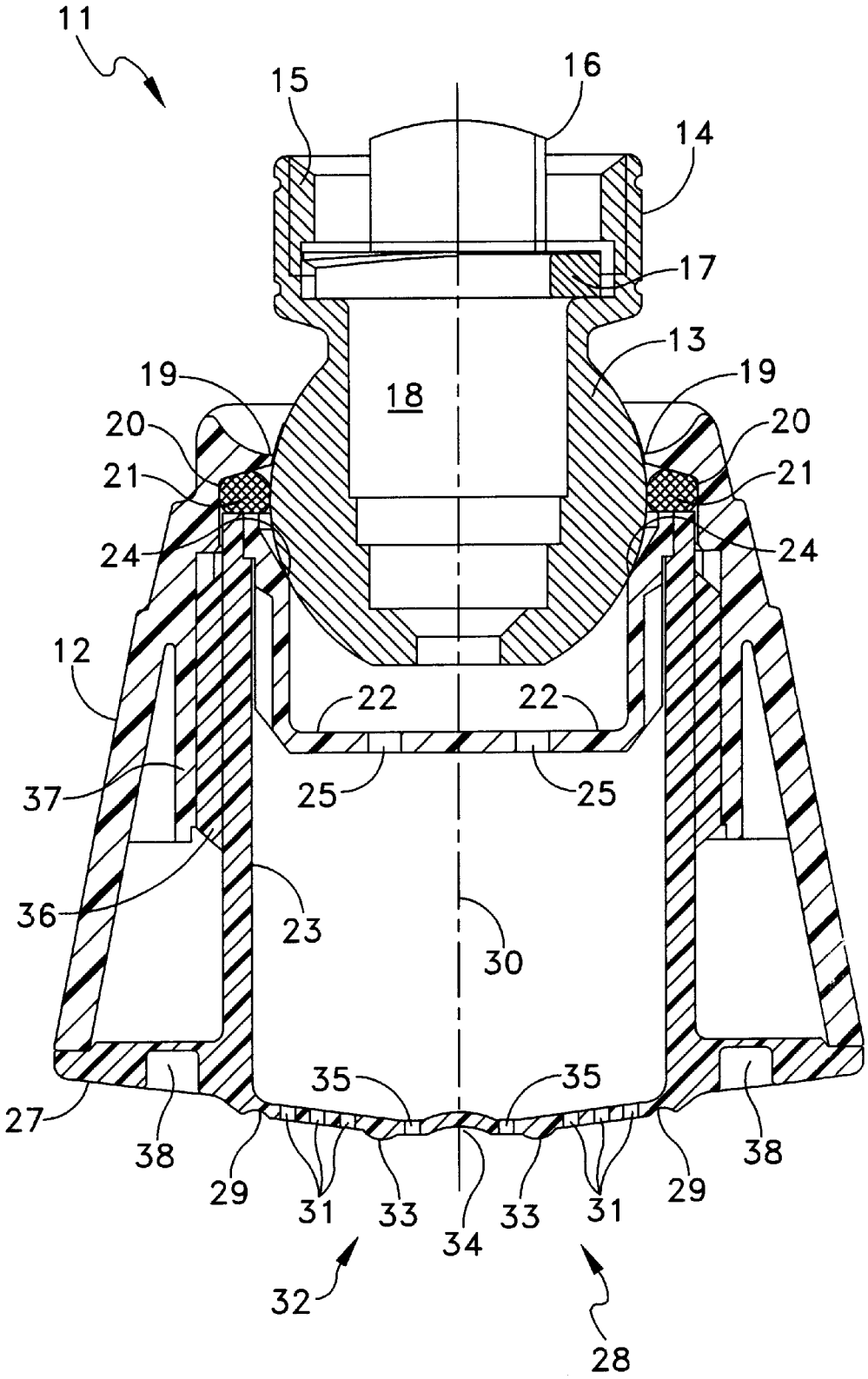
FIG. 1 A section through an inventive shower device with a jet disk having water passage channels.

FIG. 1 shows in section a shower device 11 constructed as a shower head according to the invention, which has a conically widened casing 12. In said casing 12 is placed in partly countersunk manner a substantially spherical joint 13, which passes upwards into a substantially cylindrical socket 14. In the interior of said socket 14 there is a thread 15, into which can be screwed a connecting piece 16 provided with a matching counterthread. This connecting piece 16 provided with a through bore can e.g. be a water connection for a head shower projecting out of a wall.

Shower water, which can have a temperature desired by a user as a result of an upstream mixer battery or the like, passes through the hollow connecting piece 16 into the joint 13 having a through bore. The connection between the connecting piece 16 and the socket 14 can be sealed to the outside by a sealing washer 17. The bore 18 through the spherical joint 13 can be stepped with decreasing bore diameters as from the socket 14 shaped in one piece therewith. As a result it is possible to introduce into the joint 13 inserts or the like, which can be held by the projecting shoulders of the tapering bore diameter against the water pressure occurring from above in FIG. 1.

From below, the joint 13 is inserted through an opening 19 in the casing 12 with the socket 14 at the front. The diameter of the opening 19 somewhat exceeds that of the socket 14, but is slightly less than the diameter of the preferably rotationally symmetrical joint 13. Thus, the joint 13 strikes against the circumferential rim of the opening 19. For sealing the connection between the joint 13 and the casing 12, a toroidal sealing ring 21 is placed in a groove 20, which downwardly passes round the opening 19 following onto the casing 12. It is preferably made from rubber or the like. The toroidal sealing ring 21 is held in the groove 20 formed by striking against both an upper rim of a cup-shaped insert 22 and against an upper rim of a cylindrical pipe section 23. As a result the cylindrical pipe section 23 surrounds the cup-shaped insert 22, the walls of the two parts being at least zonally in contact. By means of a projecting shoulder in the inner wall of the pipe section 23, which engages in a corresponding diameter reduction of the outer wall of the insert 22 in frictional manner, the insert 22 is pressed by the pipe section 23 against the toroidal sealing ring 21.

Moreover, as a result of a conically, downwardly tapering internal diameter in the upper region, the insert 22 has a contact zone 24, which engages on the outside diameter of the joint 13. Thus, the joint 13 is firmly seated in the casing 12 and has neither an axial, nor a radial free motion. However, it can be turned or pivoted within a certain range about the centre of its spherical outer face, the exit opening of the joint 13 remaining completely free in each pivoting position. Through the opening of the stepped bore 18 in the joint 13, the shower water passes out downwards and into the cup-shaped insert 22. The latter is provided with a ring of holes 25, made centrally in the insert. The diameter of said ring 25 is larger than that of the opening of the bore 18 in the downwards direction. In the space between the insert 22 and the joint 13, it is possible to calm down the shower water, in order to finally pass through the ring of holes 25 in the downwards direction and in a substantially calmed state.

In the downwards direction is connected to the cylindrical pipe section 23 a substantially vertically projecting flange 27, which engages at its outer end on the casing 12. A thin-walled jet disk 28 is inwardly contained in the pipe section 23. The three parts are shaped in one piece, as an assembly, by injection moulding from a thermoplastics material. The transition between the pipe section 23 and the jet disk 28 is formed by a material weakening 29, which surrounds the circular jet disk 28. In its outer region, the roughly conically, outwardly curved jet disk 28 has an inclination to the plane of the material weakening 29 of approximately 10°. In this substantially, slightly conical region, the jet disk 28 has three rows of concentric holes 31, which essentially form the water passage channels for the shower device 11. Following onto the same, the jet disk passes into a region forming a contact surface 32. In its outer region, it runs substantially perpendicularly to the longitudinal axis 30. At the transition between the bevelled region with the holes 31 and the contact surface 32 is formed an all-round stiffening ring 33 on the underside or outside of the jet disk 28.

A central region 34 of the contact surface 32 is curved inwards. This central region 34 is surrounded by a ring of holes 35, but does not itself have any holes. To it can be applied an injection access, which cannot be felt with the finger as a result of the depression in the curvature.

Shower water coming from above out of the insert 22 passes through the jet disk holes 31 and 35 out of the shower device 11. The holes 31 and 35 can be made in the jet disk 28 in such a way that they transform the shower water passing through them into shower jets, which can be oriented within a certain range as a function of the design thereof. The holes 31 and 35 can be given different configurations for obtaining different types of shower jets and this more particularly applies to their diameter and direction through the jet disk 28.

The pipe section 23 is connected to the casing 12 by means of an external thread 36 on the pipe section, which can be screwed into a corresponding thread on the inside of the casing 12. With a conical construction of the casing 12 according to FIG. 1, the internal thread 37 of the casing 12 can be formed as an additional cylindrical portion on the casing. The pipe section 23 can be screwed into the casing 12 to such an extent that, together with the insert 22, it engages frictionally on the toroidal sealing ring 21. To facilitate the screwing of the pipe section 23 into the casing 12, in the flange 27 can be provided attachment possibilities for tools. In FIG. 1 they are constructed in the form of cup-shaped, substantially cylindrical depressions 38 in the form of blind holes.

The average wall thickness of the spray or jet disk 28 is approximately 0.7 mm, but is only approximately 0.2 mm in the vicinity of the material weakening. The width of the film hinge formed by the material weakening 29 is approximately 0.5 to 1 mm and roughly corresponds to the material thickness of the jet disk 28. The circumferential stiffening ring 33 has a maximum material thickness of approximately 1.2 mm and with a semicircular cross-section can be mounted quasi-externally on the jet disk. The diameter of the contact surface is approximately 10 mm, the diameter of the upwardly curved central region being approximately 4 mm. The curvature of the central region 34 extends by a maximum of approximately 0.5 mm over the plane of the contact surface 32. The holes 31 and 35 forming the water passage channels are given an identical diameter in the case of the shower device 11 of FIG. 1, said diameter being approximately 1.1 mm. The holes in the ring 25 of the cup-shaped insert 22 have a diameter of approximately 2 mm.

The diameter of the jet disk is approximately 26 mm and the external diameter of the flange 27 approximately 45 mm. The outside radius of the circumferential stiffening ring 33 is approximately 1.2 mm, its diameter approximately 11 mm, the inside radius of a hollow, forming the material weakening 29 compared with the jet disk 28, being approximately 1 mm. The vertical clearance of the contact surface 32 of the jet disk 28 over the plane of the film hinge 29 is approximately 1.0 mm.

The connecting piece 16 and joint 13, which is connected in one piece to the socket 14, are preferably made from a metal. Brass is particularly suitable for this purpose and e.g. is given a surface treatment by chromizing. The remaining parts of the shower device 11 are made from plastic, polyoxymethylene and polypropylene being suitable.

Figure 2:
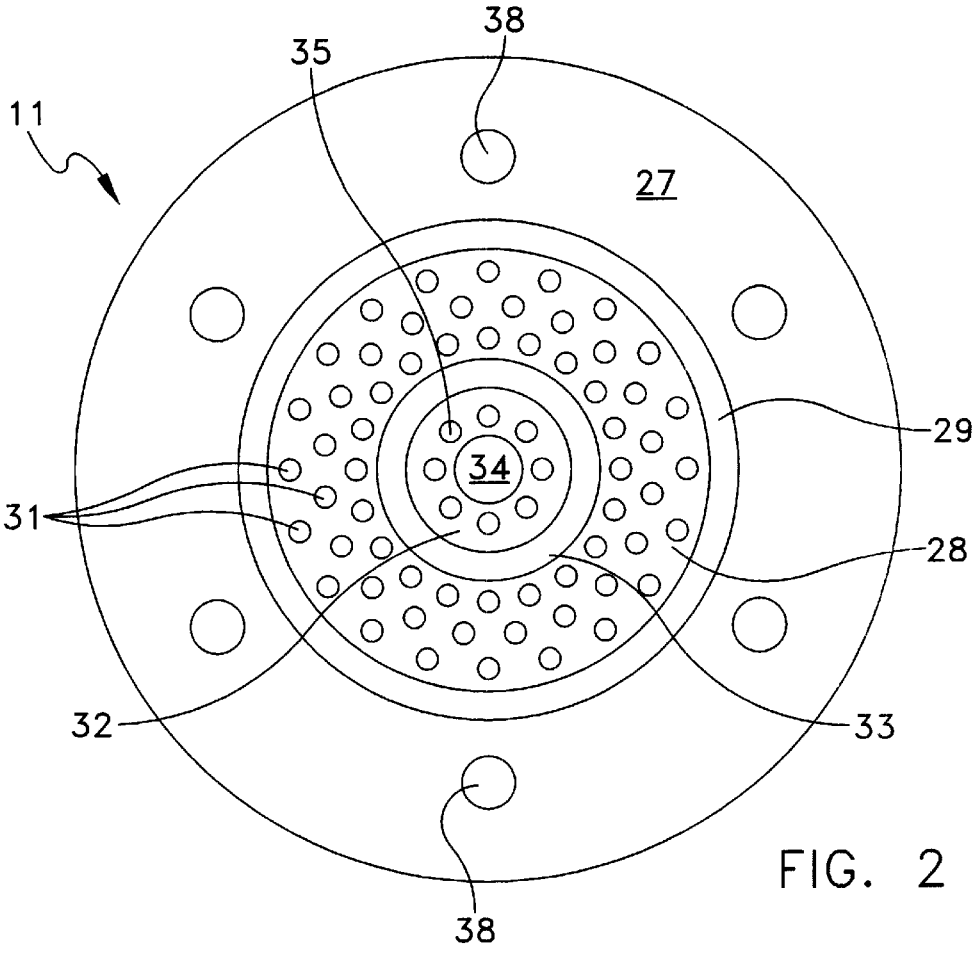
FIG. 2 A view from below of the shower device with a jet disk positioned centrally in a flange.

FIG. 2 shows the shower device 11 from below, as distinguished by the user and the rotational symmetry is clear. The flange 27 has six depressions 38 for the application of tools for the screwing of the pipe section 23 into the casing 12. Within the depressions 38, the material weakening 29 has a width of approximately 2 mm. It surrounds the jet disk 28, which is provided with three concentric rows of holes 31. As can be seen, the holes of each row are displaced with respect to those of neighbouring rows. Within the concentric rows of holes 31 passes the circumferential stiffening ring 33, which extends over a width of approximately 2 mm. It surrounds the contact surface 32, which is provided with a ring of holes 35. This ring surrounds the inwardly curved central region 34.

Figure 3:
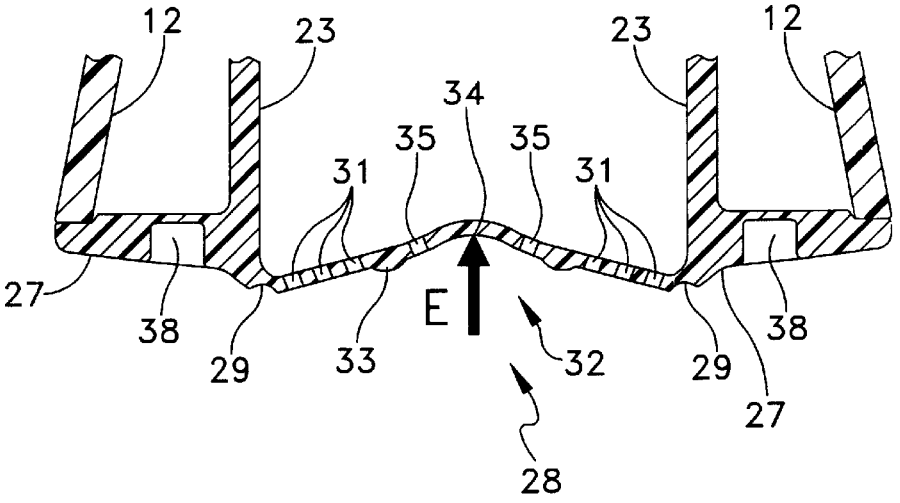
FIG. 3 A section through the lower part of a shower device according to FIG. 1 with a jet disk curved inwards by a pressing in force.

FIG. 3 shows in section the lower part of a shower device 11 according to FIG. 1, in which the jet disk 28 has been pressed inwards by a pressing in force E. As can be seen, it is curved inwards. The angle enclosing an area of the jet disk 28, located between the material weakening 29 and the stiffening ring 33 and passing roughly linearly and slightly conically, with the plane of the material weakening 29 is approximately 12°, but can also be smaller. Thus, in the case of an inward springing round, the jet disk 28 is curved somewhat further inwards than outwards in the starting position. The vertical clearance of the stiffening ring 33 over the plane of the film hinge 22 is approximately 0.9 mm and the vertical clearance of the contact surface 34 is approximately 1.6 mm.

In the case of the inward curvature and in particular during the springing round process between both positions, there can be a slight change to the diameter of the holes 31 and 35, but this is not shown in FIG. 3. Such a diameter reduction helps to blow off deposits within the holes and is consequently looked upon as advantageous.

Figure 4:
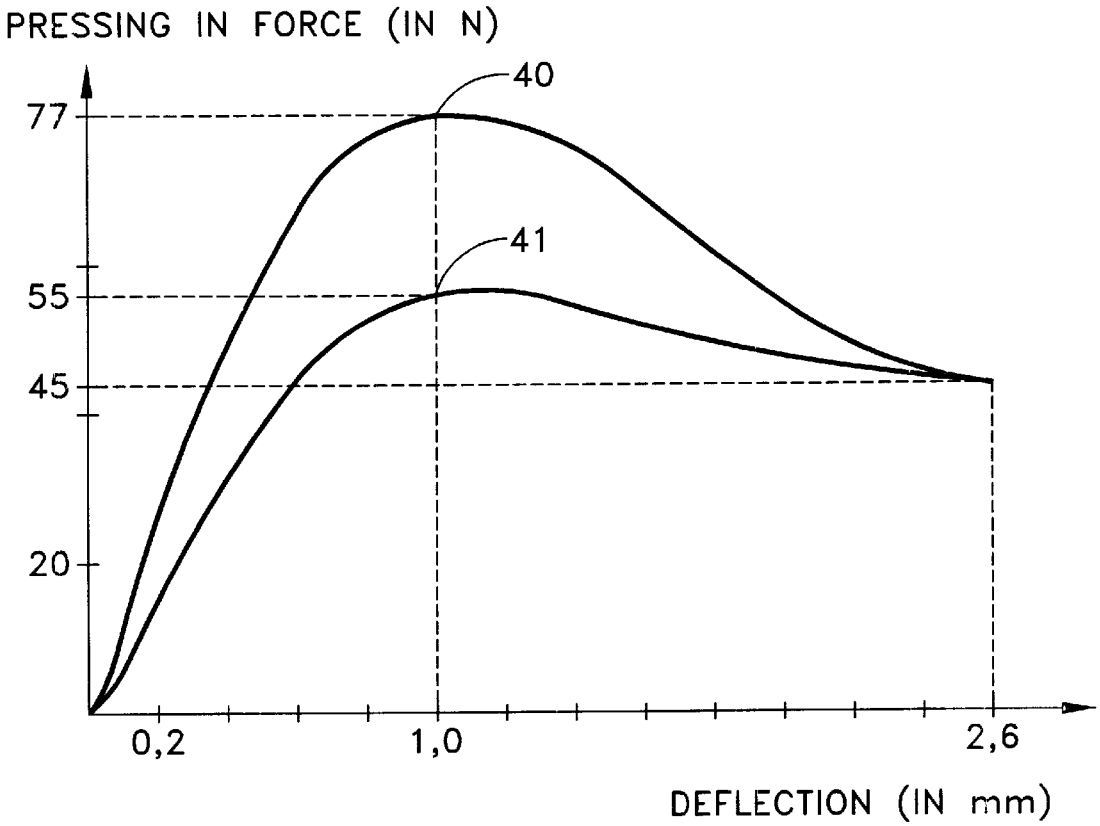
FIG. 4 A deflection-pressing in force diagram, which in exemplified manner shows a configuration of a force to be applied to the jet disk relative to the deflection as a path.

The path of the pressing in force E can be gathered from the deflection-pressing in force diagram of FIG. 4. The deflection starts in the plane of the contact surface 32 in the starting position according to FIG. 1, particularly in the vicinity of the stiffening ring 33. The curve of the pressing in force E starts in the origin and then rises steeply with decreasing gradient until it reaches a snapping in point 40 at an apex. The pressing in force E has risen to approximately 77 N, whilst the deflection in this point roughly corresponds to the vertical clearance of the contact surface 32 over the plane of the material weakness 29, amounting to approximately 1.0 mm. As from this snapping in point 40, with increasing deflection, the force curve runs steeply downwards. This means that after passing the snapping in point 40, the further inward deflection of the jet disk with a much smaller force expenditure is possible, the force maximum having been passed. The curve ends in the position of the inward curvature of the jet disk according to FIG. 3, the total deflection being approximately 2.6 mm. The force necessary for keeping the jet disk 28 in this position is approximately 45 N.

The force curve forms a type of hysteresis, in that during the springing back process of the jet disk 28, it has a different configuration compared with that during the pressing in process. Starting from the point of maximum inward curvature, the force rises again with decreasing deflection, but not as strongly as in the upper part of the curve. Thus, at the snapping back point 41, the curve reaches a lower force than in the snapping in point 40 and said force can e.g. be approximately 55 N. It forms a further force maximum, namely that for the springing back process. On passing its two maxima 40 and 41, the curve has a rounded configuration, but this can also tend to a pointed configuration.

The snapping in point 40, passed by the jet disk 28 on pressing in, can occur for the same deflection as the snapping back point 41. These are the points, which, as a function of the deflection, are passed in the moment in which the jet disk 28 snaps round and in certain circumstances produces a clearly audible noise. During the further course of the force curve, with decreasing deflection, the force decreases again and passes into the origin.

Despite the precise details concerning the force and deflection, the diagram of FIG. 4 is to be considered diagrammatically, because the shape and configuration of the individual curve portions can be varied in the case of different design possibilities of the invention. It is also not absolutely necessary for the snapping in point 40 and snapping back point 41 to be at the same deflection.

It is important for the course of the force curve to have at least four sections. At least two sections are provided for the movement process of the jet disk 28 on springing in and out. They are linked at the origin and at the end point of the maximum deflection and are interrupted by the snapping round point 40 and snapping back point 41. It is important that the force in the snapping in point 40 is above the force in the snapping back point 41.

Thus, in a preferred construction of the invention, a head shower forms the shower device 11 and has a flexible, press-in jet disk 28 with an outward curvature. The jet disk is mounted by a film hinge formed by a material weakening 29 in a flange 27 of a pipe section 23 in the head shower casing 12. As a result of the construction of the curvature and the mounting, by applying a pressing in force to the contact surface 32, the jet disk can be pressed inwards in a jump process. After removing the force, it jumps back automatically in a further jump process to the starting position and in each case the force maximum is passed.

As a result of the jump processes, lime and other deposits at the jet disk holes 31, 35 are blown off and removed.

What is claimed is:

1. Shower device with a flexible, flat jet disk, being curved outwards in at least one surface zone, said shower device further comprising a space located behind said jet disk, wherein on exceeding a specific pressing in force (E) exerted on said jet disk, said jet disk springs round suddenly with the curvature inwards into said space and when the force is relieved said jet disk springs back automatically into the starting position wherein said jet disk has at least one material weakening along a substantially closed line.

2. Shower device according to claim 1, wherein the at least one surface zone is structured to be pressed in with one finger.

3. Shower device according to claim 1, wherein said jet disk has a clearly defined contact surface for a finger for applying said force.

4. Shower device according to claim 3, wherein the contact surface is smaller than the surface zone which is structured to be pressed in with the finger.

5. Shower device according to claim 3, wherein the contact surface is framed by a stiffening.

6. Shower device according to claim 3, wherein the contact surface has a diameter of approximately 5 to 15 mm.

7. Shower device according to claim 3, wherein said jet disk has holes within the contact surface.

8. Shower device according to claim 3, wherein the contact surface is inwardly curved in a central region.

9. Shower device according to claim 8, wherein the central region is free from holes.

10. Shower device according to claim 1, wherein the material weakening is a material thinning, which is in a range between 10 and 60% of the average jet disk thickness.

11. Shower device according to claim 1, wherein the jet disk has an outer rim and said material weakening is on said jet disk outer rim.

12. Shower device according to claim 1, wherein the material weakening is annular and its radial center point coincides with the radial center point of the contact surface.

13. Shower device according to claim 1, further comprising a solid component, which is outwardly connected to said outer material weakening and frames the jet disk.

14. Shower device according to claim 13, wherein the jet disk is connectable to the solid component.

15. Shower device according to claim 13, wherein the jet disk is connected in one piece to the solid component.

16. Shower device according to claim 13, wherein the solid component has a cylindrical pipe section connectable to a shower casing.

17. Shower device according to claim 13, wherein the solid component has a solid flange connected externally to the jet disk.

18. Shower device according to claim 17, wherein the solid flange is connectable to the shower casing.

19. Shower device according to claim 1, wherein the jet disk is made from plastic and the flexibility of the jet disk is formed by a limited material thickness of the jet disk.

20. Shower device according to claim 1, wherein the material weakening has a diameter of approximately 10 to 60 mm.

21. Shower device according to claim 3, wherein the wall thickness of the material weakening is between 0.1 and 0.5 mm.

22. Shower device according to claim 1, wherein the jet disk has an average material thickness of 0.4 to 1 mm.

23. Shower device according to claim 1, wherein said jet disk has holes within the material weakening.

24. Shower device according to claim 1, wherein the at least one surface zone being curved outwards is without pretension in the starting position.

25. Shower device according to claim 24, wherein an outward curvature of the at least one surface zone is approximately 2 to 15% of the surface zone diameter.

26. Shower device according to claim 1, wherein an inward curvature of the at least one surface zone, following pressing in, is approximately 2 to 15% of the surface zone diameter.

27. Shower device according to claim 1, wherein said domed surface zone being curved outwards passes a force maximum during each springing round and springing back.

28. Shower device according to claim 1, wherein the pressing in force (E) for the surface zone is between 10 and 120 N and a restoring force of the surface zone is between 5 and 60 N.

29. Shower device according to claim 1, wherein the jet disk is made from a halogen-free thermoplastic, which is dimensionally stable up to approximately 120° C.

30. Shower device according to claim 1, wherein the jet disk is made from a thermoplastic from the group of polyoxymethylene and polypropylene.

31. Shower device according to claim 1, wherein the shower device is a head shower, comprising a shower head for connection to a fixed wall connection, said shower head being directionally adjustable by means of a spherical joint and said jet disk being flexible and round, wherein the diameter of said jet disk is approximately 26 mm.

32. Shower device with a flexible, flat jet disk, being curved outwards in at least one surface zone, said shower device further comprising a space located behind said jet disk, wherein on exceeding a specific pressing in force (E) exerted on said jet disk, said jet disk springs round suddenly with the curvature inwards into said space, and when the force is relieved said jet disk springs back automatically into the starting position, wherein said jet disk has a clearly defined contact surface for a finger for applying a force and wherein the contact surface is smaller than the surface zone which can be pressed in with the finger.

33. Shower device with a flexible, flat jet disk, being curved outwards in at least one surface zone, said shower device further comprising a space located behind said let disk, wherein on exceeding a specific pressing in force (E) exerted on said jet disk, said jet disk springs round suddenly with the curvature inwards into said space, and when the force is relieved said let disk springs back automatically into the starting position, wherein the jet disk is made from plastic and the flexibility of the jet disk is formed by a limited material thickness of the jet disk.

34. Shower device with a flexible, flat jet disk, being curved outwards in at least one surface zone, said shower device fiber comprising a space located behind said jet disk, wherein on exceeding a specific pressing in force (E) exerted on said let disk, said jet disk springs round suddenly with the curvature inwards into said space, and when the force is relieved said jet disk springs back automatically into the starting position, wherein said jet disk has a clearly defined contact surface for a finger for applying the pressing in force and wherein the contact surface is inwardly curved in a central region.

35. Shower device with a flexible, flat jet disk, being curved outwards is at least one surface zone, said shower device further comprising a space located behind said jet disk, wherein on exceeding a specific pressing in force (E) exerted on said jet disk, said jet disk springs round suddenly with the curvature inwards into said space, and when the force is relieved said jet disk springs back automatically into the starting position, wherein the jet disk is made from a halogen-free thermoplastic, which is dimensionally stable up to approximately 120° C.

36. Shower device with a flexible, flat jet disk, being curved outward in at least one surface zone, said shower device further comprising a space located behind said jet disk, wherein on exceeding a specific pressing in force (E) exerted on said jet disk, said jet disk springs round suddenly with the curvature inwards into said space, and when the force is relieved said jet disk springs back automatically into the starting position, wherein the jet disk is made from a thermoplastic from the group of polyoxymethylene and polypropylene.

37. Shower device with a flexible, flat jet disk, being curved outwards in at least one surface zone, said shower device further comprising a space located behind said jet disk, wherein on exceeding a specific pressing in force (E) exerted on said jet disk, said jet disk springs round suddenly with the curvature inwards into said space, and when the force is relieved said jet disk springs back aromatic into the starting position, wherein the shower device is a head shower, comprising a shower head for connection to a fixed wall connection said shower head being directionally adjustable by means of a spherical joint and said jet disk being flexible and round, wherein the diameter of said jet disk is approximately 26 mm.

* * * * *